US012733734B1

(12) United States Patent
Bass

(10) Patent No.: US 12,733,734 B1
(45) Date of Patent: Sep. 15, 2026

(54) MODULAR WINE RACK SYSTEM WITH CONCAVE POST MOUNTING

(71) Applicant: Kessick, LLC, Greenville, SC (US)

(72) Inventor: Robert Bass, Fountain Inn, SC (US)

(73) Assignee: Kessick, LLC, Greenville, SC (US)

( * ) Notice: Subject to any disclaimer, the term of this patent is extended or adjusted under 35 U.S.C. 154(b) by 0 days.

(21) Appl. No.: 19/077,711

(22) Filed: Mar. 12, 2025

(51) Int. Cl.

| | |
|---|---|
| ***A47B 73/00*** | (2006.01) |
| ***A47B 96/14*** | (2006.01) |
| *A47B 47/00* | (2006.01) |
| *A47B 47/02* | (2006.01) |
| *A47B 57/06* | (2006.01) |
| *A47B 57/18* | (2006.01) |

(52) U.S. Cl.
CPC ..... *A47B 73/00* (2013.01); *A47B 96/1441* (2013.01); *A47B 47/00* (2013.01); *A47B 47/021* (2013.01); *A47B 57/06* (2013.01); *A47B 57/18* (2013.01)

(58) Field of Classification Search
CPC ..... A47B 73/00; A47B 96/1441; A47B 47/00; A47B 47/0041; A47B 47/021; A47B 47/024; A47B 57/06; A47B 57/08; A47B 57/30; A47B 57/32; A47B 57/18; A47B 57/26; A47B 57/265; A47B 57/44; A47B 57/54; A47B 57/565; A47F 7/28; A47J 47/16
See application file for complete search history.

(56) References Cited

U.S. PATENT DOCUMENTS

| | | | | |
|---|---|---|---|---|
| 4,079,678 A | | 3/1978 | Champagne | |
| 4,582,001 A | | 4/1986 | Leikarts | |
| 4,615,278 A | * | 10/1986 | Cabrelli | A47B 57/265 248/188 |
| 4,763,796 A | | 8/1988 | Flum | |
| 5,012,938 A | | 5/1991 | King | |
| 5,014,487 A | | 5/1991 | King | |
| 5,148,928 A | * | 9/1992 | Arnold | F16B 12/10 211/187 |
| 5,816,419 A | * | 10/1998 | Lamson | A47B 57/045 248/242 |

(Continued)

FOREIGN PATENT DOCUMENTS

| | | |
|---|---|---|
| CN | 211186614 U | 10/2019 |
| CN | 115399584 B | 2/2022 |
| CN | 218605971 U | 11/2022 |

*Primary Examiner* — Devin K Barnett
(74) *Attorney, Agent, or Firm* — Kim and Lahey Law Firm, LLC; Seann P. Lahey

(57) ABSTRACT

The present disclosure provides a wine rack system comprising a plurality of vertically oriented posts, each post having a concave surface. A plurality of mounting brackets are included, each having a first side with a convex surface configured to engage with the concave surface of a post, a second side opposite the first side with a flat surface, and flanges extending from each side configured to extend along opposite sides of a post. The system further includes a plurality of bracket arms configured to be secured to the flat surface of a mounting bracket, and a plurality of support rods extending between opposing bracket arms to form shelves for holding wine bottles. The mounting brackets, bracket arms, and support rods combine to create a modular and adjustable wine storage system that securely attaches to the vertical posts.

7 Claims, 8 Drawing Sheets

(56) References Cited

U.S. PATENT DOCUMENTS 5,971,175 A 10/1999 Bustos
6,302,284 B1 * 10/2001 Zonshin ..... A47B 47/0083 108/147.11
7,131,544 B1 * 11/2006 Cunningham ..... A47B 73/006 206/139
8,016,140 B2 9/2011 Hsieh
D722,845 S * 2/2015 Lesage ..... D7/701
9,078,516 B2 7/2015 Vogel
9,326,602 B2 * 5/2016 Gupta ..... A47B 96/066
D781,111 S * 3/2017 Koder ..... D7/619.1
9,763,515 B2 * 9/2017 Fratilla ..... A47B 73/00
11,559,139 B2 * 1/2023 Ervin ..... A47F 7/283
11,678,742 B1 * 6/2023 Hogeback ..... A47B 57/404 211/74
11,723,458 B2 8/2023 Jensen
11,744,362 B1 * 9/2023 Floarea ..... A47B 45/00 211/90.01
2010/0006523 A1 * 1/2010 Hogeback ..... A47F 7/28 211/74
2011/0233164 A1 9/2011 Chang
2014/0110364 A1 * 4/2014 Vogel ..... F21S 4/26 211/74
2014/0339182 A1 * 11/2014 Koder ..... A47F 7/283 211/74
2015/0034577 A1 * 2/2015 Cash ..... A47B 49/00 211/74
2016/0000225 A1 * 1/2016 Kuo ..... A47B 96/028 211/119.009
2016/0106207 A1 * 4/2016 Wickett ..... A47B 57/04 211/175
2019/0110591 A1 * 4/2019 Chu ..... A47B 61/003
2021/0219719 A1 * 7/2021 Jensen ..... A47B 96/1425
2021/0259411 A1 * 8/2021 Fratilla ..... A47B 57/46
2023/0337818 A1 * 10/2023 Jensen ..... A47B 73/00
2024/0407547 A1 * 12/2024 Zhu ..... A47B 73/00
2025/0261753 A1 * 8/2025 Hanlon ..... A47B 57/545

* cited by examiner

MODULAR WINE RACK SYSTEM WITH CONCAVE POST MOUNTING

FIELD OF INVENTION

The present disclosure relates to wine storage systems, and more particularly to a modular wine rack system with vertical posts having concave surfaces for engaging complementary mounting brackets.

BACKGROUND

Wine storage and display systems have long been utilized by wine enthusiasts, collectors, and businesses to organize and showcase wine bottles. Traditional wine racks often consist of fixed wooden or metal structures with compartments sized to hold individual bottles. While functional, these conventional designs can be limiting in terms of capacity, configuration options, and aesthetic appeal.

More recently, modular wine rack systems have emerged to provide greater flexibility. These typically employ vertical support posts and horizontal cross members that can be assembled in various arrangements. However, existing modular systems may have drawbacks related to stability, ease of assembly and reconfiguration, or visual integration with different decor styles.

Wine bottles present unique storage requirements due to their shape and the need to keep corks moist. Proper storage position can impact wine preservation, while visibility of labels facilitates selection. Accommodating different bottle sizes and shapes adds further complexity to rack design. Additionally, complementary storage for wine glasses, decanters, and other accessories is often desirable.

For commercial and high-end residential applications, wine storage systems that offer both functional performance and an upscale, customized appearance are in demand. Sleek, modern aesthetics have become increasingly popular. However, achieving a refined look while maintaining modularity and ease of installation can be challenging with conventional rack components and mounting methods.

There remains room for improvement in modular wine rack systems to enhance stability, simplify assembly and reconfiguration, expand design possibilities, and elevate aesthetics. Advancements in these areas could benefit wine enthusiasts, collectors, and businesses seeking versatile, attractive wine storage and display solutions.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

According to an aspect of the present disclosure, a mounting bracket for a wine rack system is provided. The mounting bracket includes a first side having a convex surface for engaging with a concave surface of a post, and a second opposite side that is flat for receiving a bracket arm. The mounting bracket further includes a flange on each side that extends along opposite sides of the post to resist lateral movement. The mounting bracket also includes at least one recessed opening for receiving a screw and screw head flush within or below the flat surface of the second side to avoid interfering with the bracket arm.

According to other aspects of the present disclosure, the mounting bracket may include one or more of the following features. The mounting bracket may include at least one threaded opening in the second side for receiving a screw to secure the bracket arm to the mounting bracket. The mounting bracket may include a bracket recess disposed between the flange and the bracket arm when mounted to the post, the bracket recess configured to partially receive an endcap of a rod.

According to another aspect of the present disclosure, a wine rack system is provided. The wine rack system includes a series of vertically oriented posts having concave surfaces, and a plurality of mounting brackets. Each mounting bracket includes a first side having a convex surface for engaging with the concave surfaces of the posts, and a second opposite side that is flat for receiving a bracket arm. Each mounting bracket further includes a flange on each side that extends along opposite sides of a post to resist lateral movement, and at least one recessed opening for receiving a screw and screw head flush within or below the flat surface of the second side to avoid interfering with the bracket arm. The wine rack system also includes a plurality of bracket arms secured to the mounting brackets, and a series of rods extending between opposing bracket arms to form shelves to hold wine bottles.

According to other aspects of the present disclosure, the wine rack system may include one or more of the following features. Each rod may include an endcap that includes a securing shaft which extends through a shaft opening of the bracket arm and engages with a distal end of the rod to secure the rod to the bracket arm. The securing shaft may be a screw. The endcaps adjacent the mounting brackets may be partially received into a bracket recess disposed between the flange and the bracket arm when mounted to the posts. The rods may be secured to the bracket arms using screws, and the screw heads may be covered with endcaps. The posts may include screw openings for receiving screws to secure the mounting brackets to the posts. Alternatively, the screws may be self-tapping screws that drill into and secure to the posts.

The foregoing general description of the illustrative embodiments and the following detailed description thereof are merely exemplary aspects of the teachings of this disclosure and are not restrictive.

BRIEF DESCRIPTION OF FIGURES

The system designed to carry out the invention will hereinafter be described, together with other features thereof. Non-limiting and non-exhaustive examples are described with reference to the following figures. The invention will be more readily understood from a reading of the following specification and by reference to the accompanying drawings forming a part thereof, wherein an example of the invention is shown and wherein.

Figure 1:
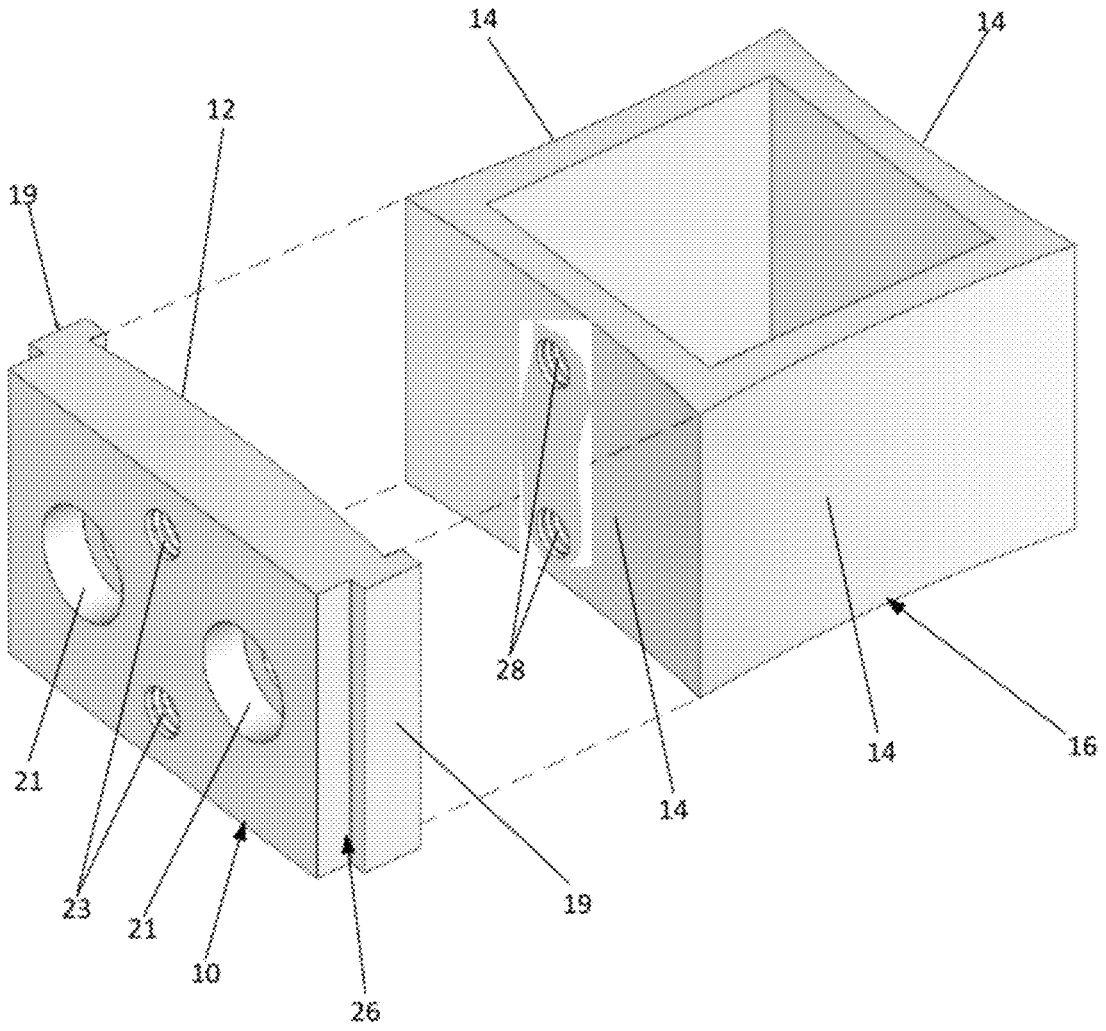
FIG. 1 illustrates an exploded view of a mounting system for a wine rack, according to aspects of the present disclosure.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION

The following description sets forth exemplary aspects of the present disclosure. It should be recognized, however, that such description is not intended as a limitation on the scope of the present disclosure. Rather, the description also encompasses combinations and modifications to those exemplary aspects described herein.

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The present disclosure relates to a modular wine rack system with a unique mounting mechanism. This system may provide an efficient and aesthetically pleasing solution for storing and displaying wine bottles. The modular nature of the system may allow for customizable configurations to suit various spaces and storage needs.

In some cases, the wine rack system may utilize vertical posts with concave surfaces. These concave surfaces may interface with complementary convex surfaces on mounting brackets, potentially creating a secure and visually appealing connection. This mounting mechanism also offer advantages in terms of stability and ease of assembly.

The system may incorporate various components such as bracket arms, support rods, and endcaps, which may work together to create a versatile storage solution. The design may allow for different orientations of wine bottles, potentially accommodating both horizontal storage and angled display configurations.

In some implementations, the modular nature of the system may permit expansion or reconfiguration as a user's wine collection grows or storage needs change. The components may be designed for compatibility, potentially allowing users to add or rearrange elements as desired.

The wine rack system may be suitable for use in various settings, such as residential wine cellars, commercial wine shops, or restaurants. The design may aim to combine functionality with aesthetic appeal, potentially enhancing the presentation of wine bottles while providing practical storage solutions.

In some cases, the wine rack system may include a vertical post 16. As shown in FIG. 1, the vertical post 16 may have a concave surface 14. The concave surface 14 may extend along the length of the vertical post 16, providing a curved profile that may interface with other components of the system.

Figure 2:
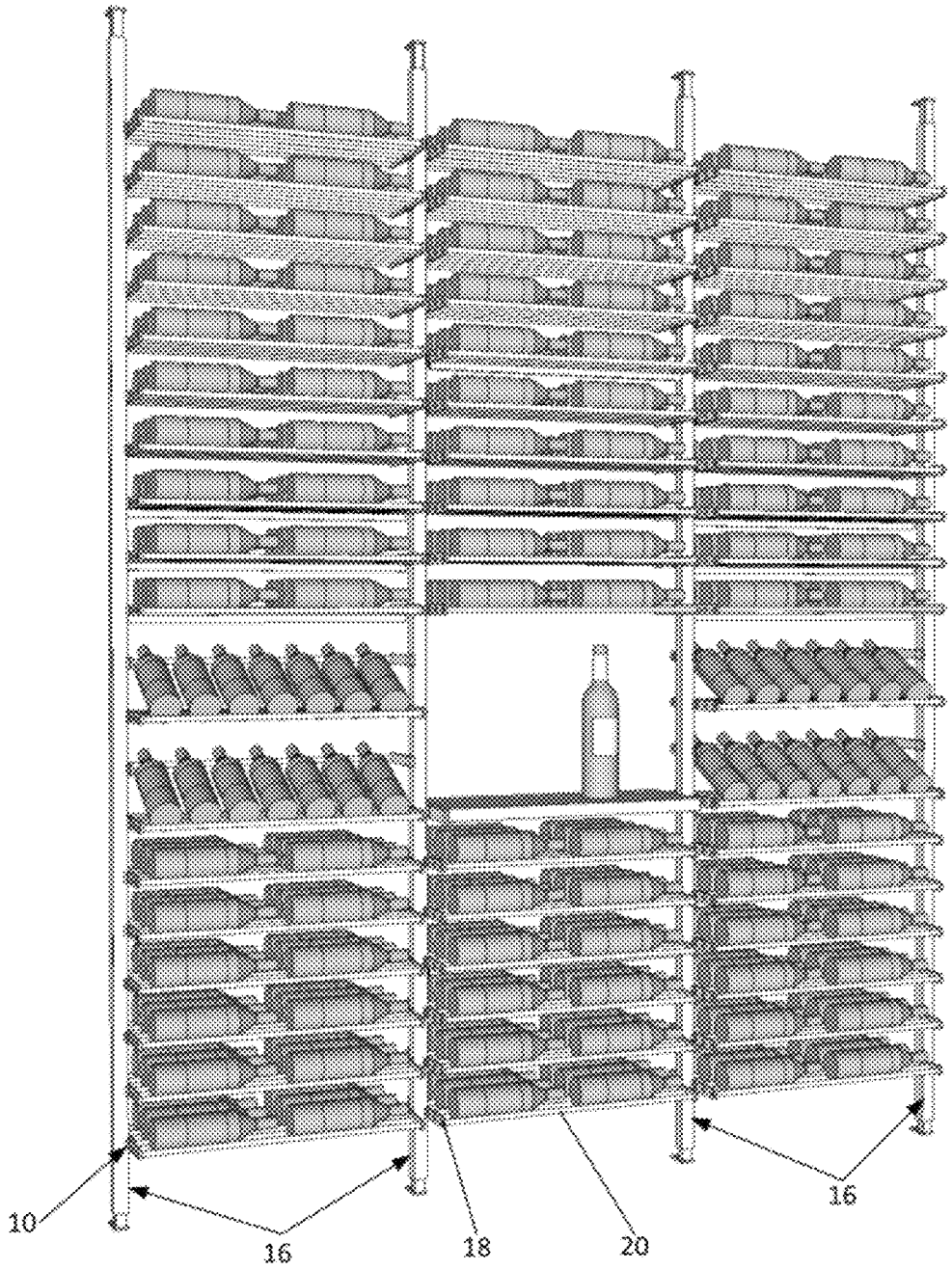
FIG. 2 illustrates a perspective view of a wine bottle storage rack system, according to an embodiment.

FIG. 2 illustrates multiple vertical posts 16 arranged in a parallel configuration. The vertical posts 16 may be spaced at specific intervals to accommodate other components of the wine rack system. In some implementations, the vertical posts 16 may have concave surfaces 14 on multiple sides, allowing for versatile attachment options.

Figure 4:
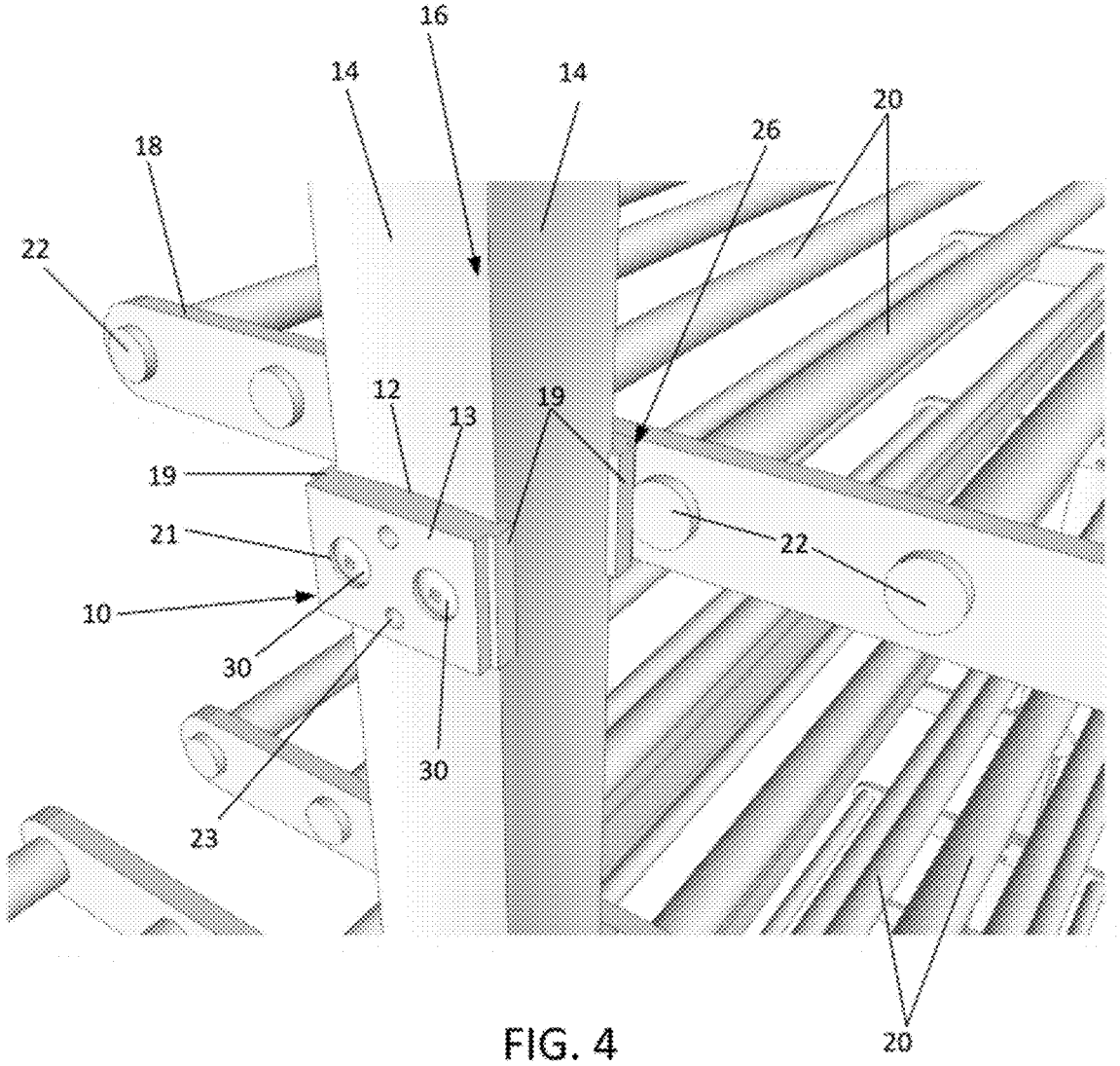
FIG. 4 illustrates a perspective view of a mounting system showing component connections, according to aspects of the present disclosure.

As depicted in FIG. 4, the vertical post 16 may include a screw opening 28. The screw opening 28 may be configured to receive a screw for securing other components to the vertical post 16. In some cases, the screw may be a self-tapping screw that may drill into and secure to the vertical post 16, potentially eliminating the need for pre-drilled holes.

Figure 6:
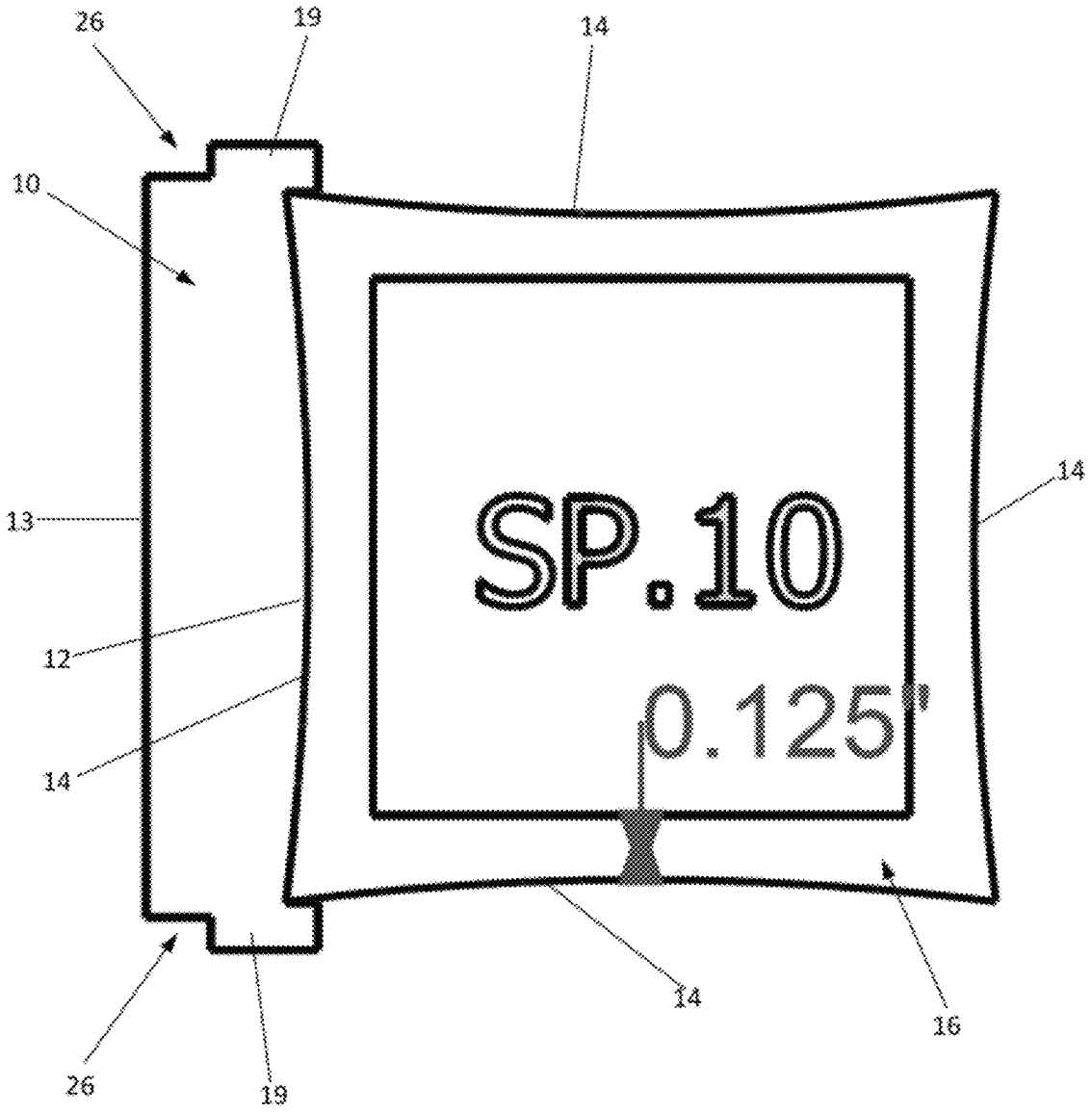
FIG. 6 shows a top view of a mounting bracket engaging a vertical post, according to aspects of the present disclosure.

FIG. 6 provides a top view of the vertical post 16, clearly showing the concave surface 14. This concave profile may contribute to the overall system design by providing a complementary surface for mounting brackets and other components.

In some implementations, the vertical post 16 may be constructed from thick-walled anodized aluminum. This material choice may provide durability and strength to the wine rack system while also offering aesthetic benefits.

Figure 3:
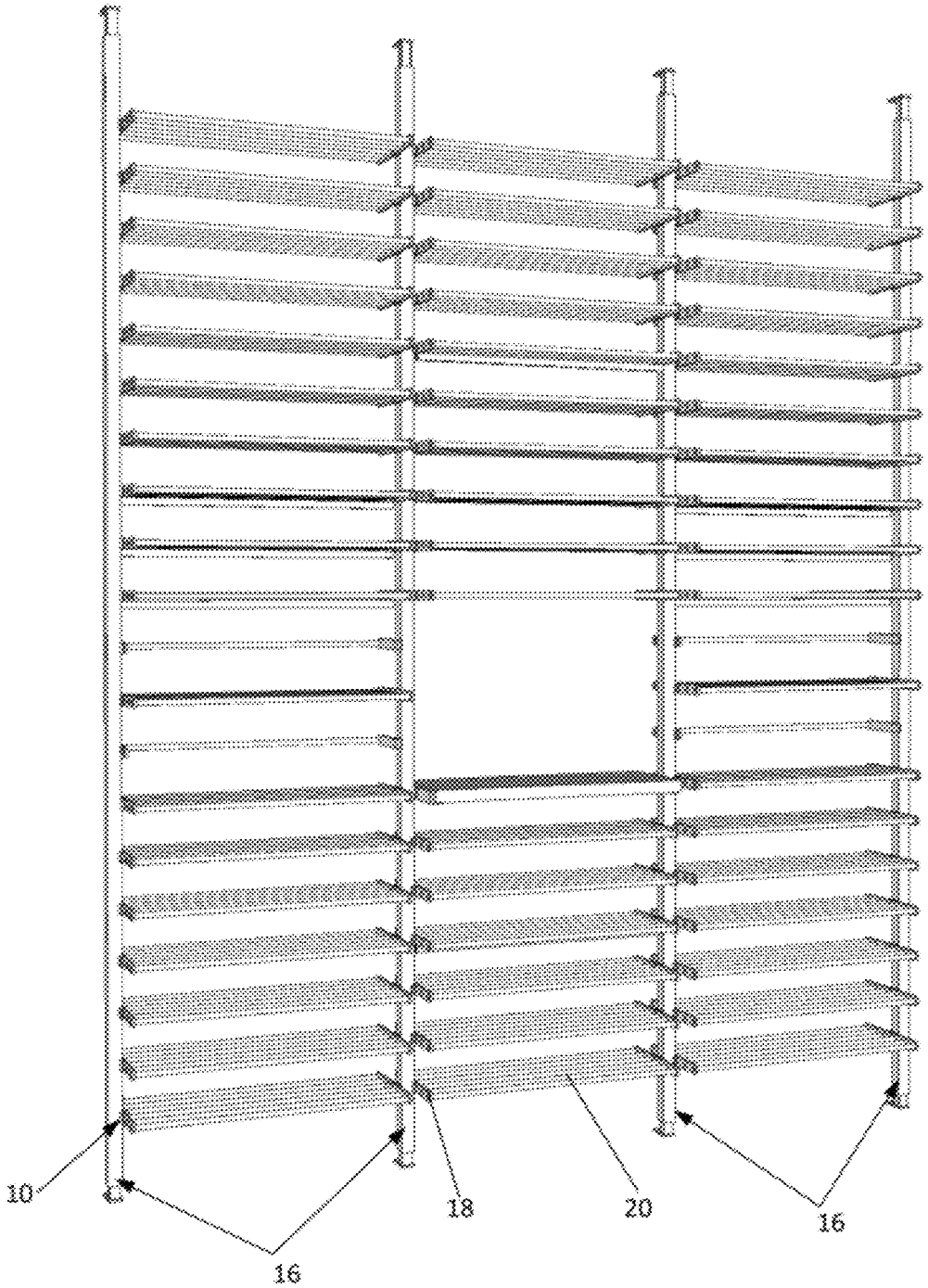
FIG. 3 illustrates a perspective view of a wine rack system, in accordance with example embodiments.
Figure 7:
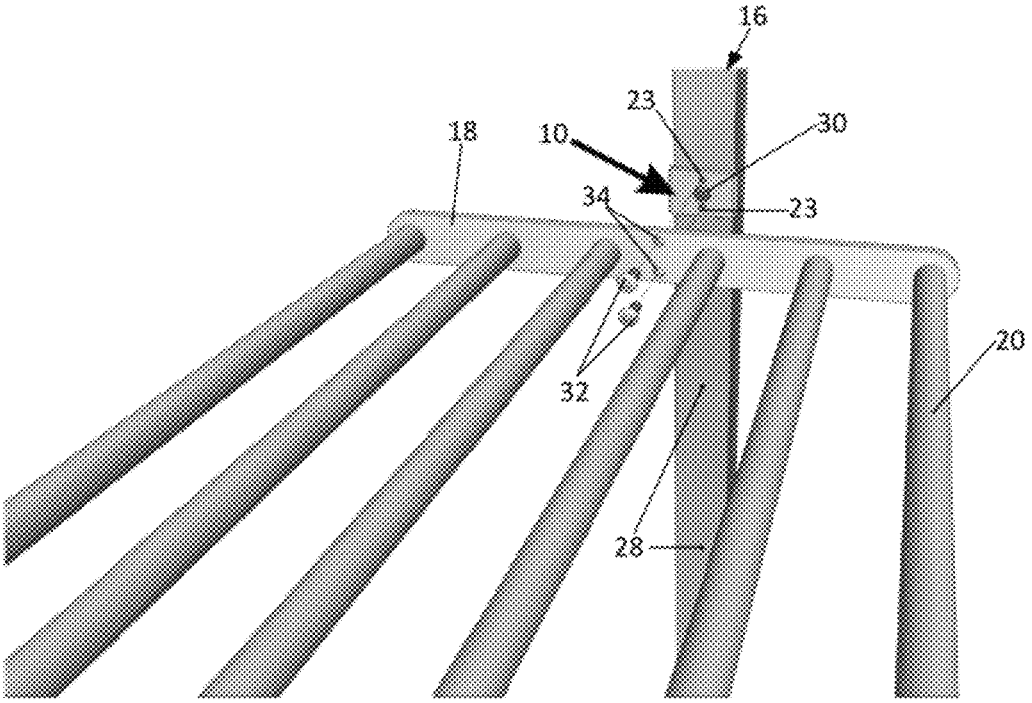
FIG. 7 illustrates a partial perspective view of a wine rack mounting system, according to an embodiment.

The arrangement of vertical posts 16, as shown in FIG. 3 and FIG. 7, may allow for a modular design where multiple sections can be combined to create a larger storage capacity. The concave surfaces 14 of the vertical posts 16 may facilitate secure attachment of other components while maintaining a sleek appearance.

In some cases, the wine rack system may include a mounting bracket 10. As shown in FIG. 1, the mounting bracket 10 may have a convex surface 12. The convex surface 12 may be configured to engage with the concave surface 14 of the vertical post 16, potentially creating a secure connection between the components.

FIG. 4 illustrates that the mounting bracket 10 may include a flat second side surface 13. The flat second side surface 13 may be opposite to the convex surface 12 and may provide an interface for attaching other components of the wine rack system.

As depicted in FIG. 1 and FIG. 6, the mounting bracket 10 may include side flanges 19. The side flanges 19 may extend along opposite sides of the mounting bracket 10 and may be configured to engage with the sides of the vertical post 16, potentially providing lateral stability to the mounting arrangement.

In some implementations, the mounting bracket 10 may include at least one recessed opening 21, as shown in FIG. 1 and FIG. 4. The recessed opening 21 may be configured to receive a screw and screw head flush within or below the flat second side surface 13 of the mounting bracket 10. This configuration may allow for a smooth surface for attaching other components to flat second side surface 13.

FIG. 1 and FIG. 7 illustrate that the mounting bracket 10 may include threaded openings 23. The threaded openings 23 may be configured to receive screws for securing additional components to the mounting bracket 10.

As shown in FIG. 1 and FIG. 6, the mounting bracket 10 may include a bracket recess 26. The bracket recess 26 may be formed between the side flange 19 and where other components attach to the mounting bracket 10, potentially providing clearance for additional hardware or components.

In some cases, a screw may extend through the mounting bracket 10 and into the vertical post 16 to secure the mounting bracket 10 to the vertical post 16. The screw may be received by the screw opening 28 in the vertical post 16, as illustrated in FIG. 1 and FIG. 7.

The mounting bracket 10 may include pre-drilled pilot holes in some implementations. These pilot holes may facilitate the attachment of the mounting bracket 10 to the vertical post 16 or the attachment of other components to the mounting bracket 10.

In some cases, a pair of machine screws may fasten a diverse range of brackets to the mounting bracket 10. This configuration may allow for versatility in attaching various components to the wine rack system.

In some cases, the wine rack system may include a bracket arm 18. As shown in FIG. 2 and FIG. 3, the bracket arm 18 may extend horizontally from the mounting bracket 10. The bracket arm 18 may be constructed from a durable material, such as metal, to provide sturdy support for other components of the wine rack system.

Figure 5:
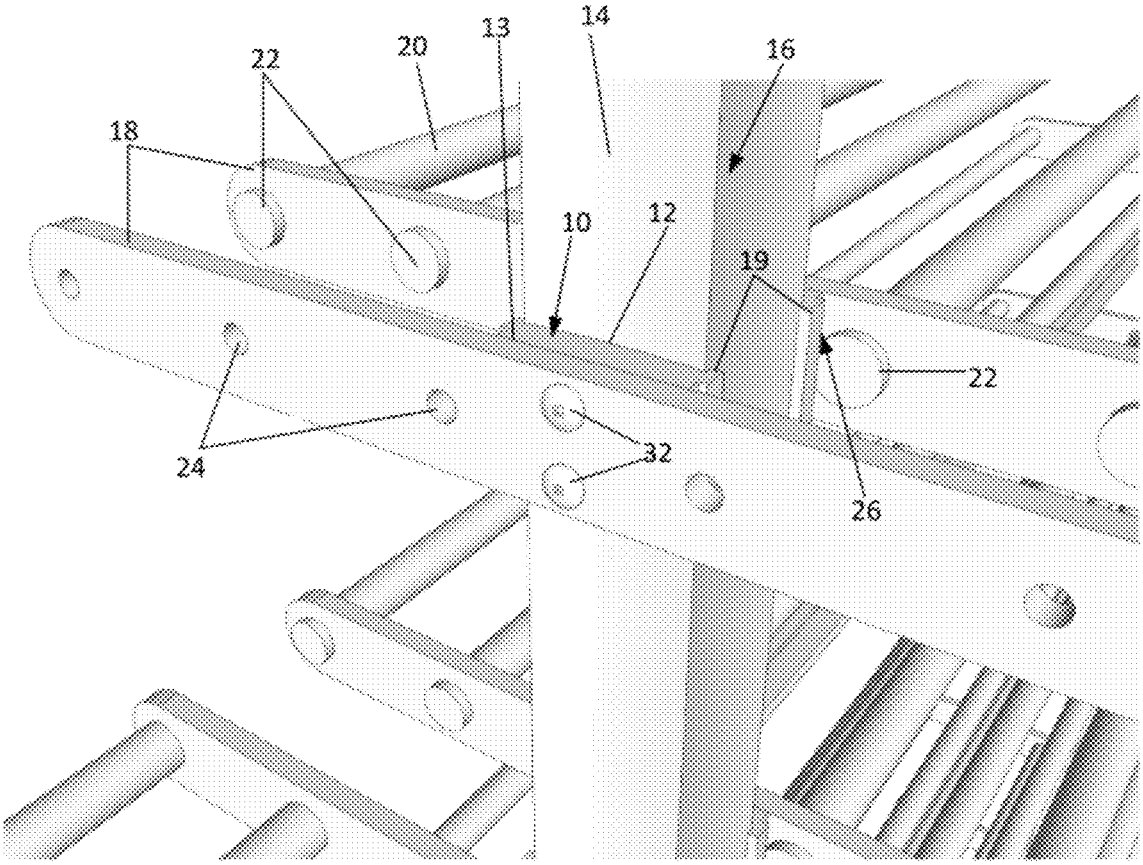
FIG. 5 illustrates a perspective view of a portion of a wine rack mounting system, according to an embodiment.

FIG. 4 and FIG. 5 illustrate that the bracket arm 18 may be designed to mount flush against the flat second side surface 13 of the mounting bracket 10. This configuration may provide a secure and stable connection between the bracket arm 18 and the mounting bracket 10.

Figure 8:
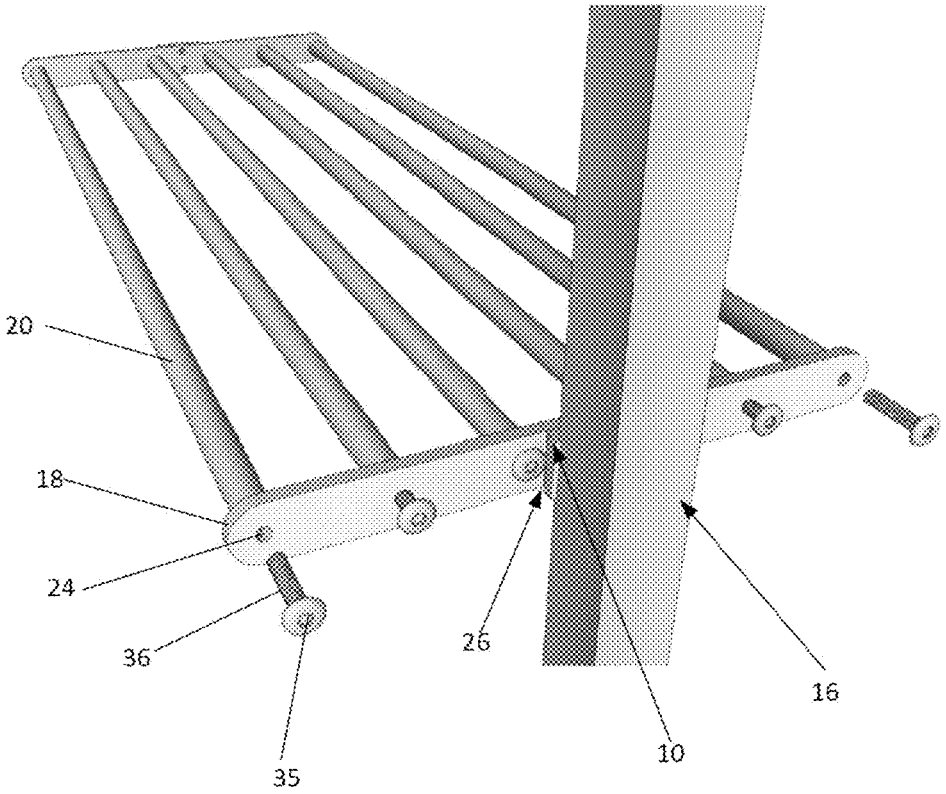
FIG. 8 illustrates a perspective view of a portion of a wine rack mounting system, in accordance with example embodiments.

In some implementations, the bracket arm 18 may include a shaft opening 24, as depicted in FIG. 5 and FIG. 8. The shaft opening 24 may be configured to accommodate support rods or other components of the wine rack system.

FIG. 7 shows that the bracket arm 18 may include a bracket arm opening 34. The bracket arm opening 34 may be designed to align with the threaded opening 23 in the mounting bracket 10. This alignment may facilitate the secure attachment of the bracket arm 18 to the mounting bracket 10.

In some cases, screws may extend through the bracket arm openings 34 in the bracket arm 18 and engage with the complementary threaded openings 23 in the mounting bracket 10. This configuration may secure the bracket arm 18 and the mounting bracket 10 together, creating a stable assembly for supporting other components of the wine rack system.

The bracket arm 18 may be designed to provide support for support rods that extend between opposing bracket arms 18. As illustrated in FIG. 2 and FIG. 3, the bracket arm 18 may extend outward from the vertical post 16, creating a surface or structure upon which the support rods may rest or attach.

In some implementations, the bracket arm 18 may be positioned in relation to the side flange 19 of the mounting bracket 10 to form the bracket recess 26, as shown in FIG. 4 and FIG. 5. This arrangement may provide clearance for additional hardware or components of the wine rack system.

In some cases, the wine rack system may include a support rod 20. As shown in FIG. 2 and FIG. 3, the support rod 20 may extend between opposing bracket arms 18. The support rod 20 may be designed to create horizontal storage surfaces between the vertical posts 16, providing a stable platform for storing wine bottles.

FIG. 4 and FIG. 5 illustrate that the support rod 20 may be positioned parallel to other support rods 20, creating multiple levels of storage within the wine rack system. The arrangement of the support rods 20 may allow for efficient use of space and accommodate various bottle sizes.

In some implementations, the support rod 20 may include a rod endcap 22, as depicted in FIG. 4 and FIG. 5. The rod endcap 22 may be positioned at each end of the support rod 20. The rod endcap 22 may serve multiple purposes, including providing a finished appearance to the ends of the support rod 20 and facilitating the attachment of the support rod 20 to the bracket arm 18.

As shown in FIG. 5, the rod endcap 22 may include a securing shaft. The securing shaft may extend through the shaft opening 24 of the bracket arm 18. This configuration may allow for secure attachment of the support rod 20 to the bracket arm 18, potentially enhancing the stability of the wine rack system.

In some cases, the securing shaft of the rod endcap 22 may be a screw. The screw may engage with the distal end of the support rod 20, securing the rod endcap 22 and, by extension, the support rod 20 to the bracket arm 18. This arrangement may provide a robust connection between components while allowing for potential disassembly if needed.

FIG. 8 illustrates an alternative configuration where the support rods 20 may be secured to the bracket arms 18 using fastening screws 36. In this arrangement, the screw head 35 of the fastening screw 36 may be covered with a rod endcap 22. This configuration may provide a clean, finished appearance while maintaining the secure attachment of the support rod 20 to the bracket arm 18.

As depicted in FIG. 4 and FIG. 5, the rod endcaps 22 adjacent to the mounting bracket 10 may be partially received into the bracket recess 26. The bracket recess 26 may be disposed between the side flange 19 and the bracket arm 18 when mounted to the vertical posts 16. This arrangement may avoid interference between the rod endcap 22 and the mounting bracket 10, potentially allowing for a more compact and streamlined design.

In some implementations, the support rods 20 and their associated rod endcaps 22 may be designed to accommodate various bottle sizes and orientations. As shown in FIG. 2, the arrangement of the support rods 20 may allow for both horizontal storage of wine bottles and angled display configurations, potentially enhancing the versatility of the wine rack system.

In some cases, the wine rack system may utilize various fastening mechanisms to secure components together. FIG. 4 illustrates a bracket mounting screw 30 that may extend through the recessed opening 21 of the mounting bracket 10 and into the vertical post 16. The bracket mounting screw 30 may secure the mounting bracket 10 to the vertical post 16, potentially creating a stable foundation for the wine rack system.

FIG. 5 and FIG. 7 depict an arm mounting screw 32 that may be used to attach the bracket arm 18 to the mounting bracket 10. The arm mounting screw 32 may extend through the bracket arm opening 34 in the bracket arm 18 and engage with the threaded opening 23 in the mounting bracket 10. This configuration may provide a secure connection between the bracket arm 18 and the mounting bracket 10.

In some implementations, as shown in FIG. 8, fastening screws 36 may be employed to secure the support rods 20 to the bracket arms 18. The fastening screws 36 may extend through the shaft openings 24 in the bracket arms 18 and engage with the support rods 20. The screw head 35 of the fastening screw 36 may be visible in this arrangement, providing a direct means of attachment.

FIG. 4 and FIG. 5 illustrate that the rod endcaps 22 adjacent to the mounting bracket 10 may be partially received into the bracket recess 26. The bracket recess 26 may be disposed between the side flange 19 and the bracket arm 18 when mounted to the vertical posts 16. This arrangement may avoid interference between the rod endcap 22 and the mounting bracket 10, potentially allowing for a more compact assembly.

In some cases, the recessed opening 21 in the mounting bracket 10 may be designed to receive the bracket mounting screw 30 such that the screw head may sit flush with or below the flat second side surface 13 of the mounting bracket 10. This configuration may prevent interference with the bracket arm 18 when it is mounted against the flat second side surface 13.

The fastening mechanisms described may work in conjunction with the complementary shapes of the components, such as the convex surface 12 of the mounting bracket 10 engaging with the concave surface 14 of the vertical post 16, to create a secure and stable wine rack system. These various fastening methods may allow for efficient assembly and disassembly of the wine rack components while maintaining structural integrity.

In some cases, the wine rack system may be assembled to create a functional and modular storage solution. FIG. 2 illustrates a perspective view of the assembled wine rack system, showcasing the interaction between various components. The vertical posts 16 may serve as the primary structural elements, providing a foundation for the entire system.

The mounting brackets 10 may be attached to the vertical posts 16 at various heights, as depicted in FIG. 2 and FIG. 3. The convex surface of the mounting brackets 10 may engage with the concave surface of the vertical posts 16, potentially creating a secure connection. In some cases, the side flanges of the mounting brackets 10 may extend along the sides of the vertical posts 16, potentially enhancing lateral stability.

Bracket arms 18 may be secured to the mounting brackets 10, as shown in FIG. 2 and FIG. 3. The bracket arms 18 may extend horizontally from the vertical posts 16, creating support structures for the support rods 20. The flat second side surface of the mounting brackets 10 may provide a stable interface for attaching the bracket arms 18.

Support rods 20 may span between opposing bracket arms 18, as illustrated in FIG. 2 and FIG. 3. These support rods 20 may create horizontal storage surfaces for wine bottles. The arrangement of support rods 20 may allow for various bottle orientations, potentially accommodating both horizontal storage and angled display configurations.

In some implementations, the wine rack system may include countertop connectors. These connectors may allow the vertical posts 16 to be securely attached to a countertop surface, potentially providing stability for freestanding configurations. Wall connectors may also be utilized in some cases, enabling the vertical posts 16 to be mounted directly to a wall for space-efficient installations.

The wine rack system may also incorporate telescoping ceiling connectors in some cases. These connectors may allow the vertical posts 16 to be extended and secured between the floor and ceiling, potentially creating floor-to-ceiling storage solutions. The telescoping feature may accommodate various ceiling heights, enhancing the system's adaptability to different spaces.

The modular nature of the wine rack system, as depicted in FIG. 2 and FIG. 3, may allow for customizable configurations. Additional vertical posts 16, mounting brackets 10, bracket arms 18, and support rods 20 may be added or rearranged to expand or modify the storage capacity. This modularity may enable users to adapt the system to changing storage needs or space constraints.

In some cases, the assembly process may involve securing the mounting brackets 10 to the vertical posts 16 using bracket mounting screws. The bracket arms 18 may then be attached to the mounting brackets 10 using arm mounting screws. Support rods 20 may be installed between opposing bracket arms 18, potentially utilizing rod endcaps or fastening screws for secure attachment.

The combination of these components and assembly methods may result in a stable and versatile wine rack system. The system may be capable of accommodating various bottle sizes and quantities while providing options for different installation methods and configurations.

A number of implementations have been described. Nevertheless, it will be understood that various modifications may be made without departing from the spirit and scope of the disclosure. Accordingly, other implementations are within the scope of the following claims.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventor did not consider such subject matter to be part of the disclosed inventive subject matter.

What is claimed is:

1. A wine rack system, comprising:

a plurality of vertically oriented posts, each post having a concave surface;

a plurality of mounting brackets, each mounting bracket comprising:

a first side having a convex surface configured to engage with the concave surface of a post, a second side opposite the first side and having a flat surface, and at least one recessed opening configured to receive a screw and screw head flush within or below the flat surface of the second side, and a flange extending from each side of the mounting bracket configured to extend along opposite sides of a respective post from said plurality of posts, wherein the flanges extend from the first side of each mounting bracket and the flanges are perpendicular relative to the second side of each mounting bracket, and wherein the flanges are configured to engage opposite sides of the respective post when mounted to resist lateral movement of the mounting bracket;

a plurality of bracket arms, each bracket arm configured to be secured to the flat surface of a respective mounting bracket from the plurality of mounting brackets; and a plurality of support rods extending between respective opposing bracket arms from said plurality of bracket arms to form shelves for holding wine bottles.

2. The wine rack system of claim 1, wherein the convex surface of the first side of each mounting bracket has a curvature complementary to the concave surface of each respective post for a uniform engagement between the first side and the concave surface of each respective post.

3. The wine rack system of claim 2, wherein each mounting bracket further comprises at least one threaded opening in the second side configured to receive a screw to secure a respective bracket arm to the mounting bracket.

4. The wine rack system of claim 3, wherein each mounting bracket further comprises a bracket recess disposed along a side surface of the mounting bracket between the first side and the second side, the bracket recess being adjacent the respective bracket arm and configured to provide clearance for an endcap of a respective support rod to avoid interference between the endcap and the mounting bracket.

5. The wine rack system of claim 1, wherein each support rod comprises an endcap at each end, each endcap includes a securing shaft configured to extend through a shaft opening of a respective bracket arm from the plurality of bracket arms and engage with a distal end of a respective support rod from the plurality of support rods.

6. The wine rack system of claim 5, wherein each securing shaft is a screw.

7. The wine rack system of claim 1, wherein the posts include screw openings configured to receive the screws to secure the mounting brackets to the posts.

* * * * *